United States Patent [19]

Lawlor

[11] 4,225,087

[45] Sep. 30, 1980

[54] LOCK-OFF MEANS FOR AIRLESS SPRAYER

[75] Inventor: Christopher Lawlor, North Ridgeville, Ohio

[73] Assignee: The Sherwin-Williams Company, Cleveland, Ohio

[21] Appl. No.: 770,563

[22] Filed: Feb. 22, 1977

[51] Int. Cl.[3] ..... B05B 7/02

[52] U.S. Cl. ..... 239/526; 251/99; 251/109; 251/116; 251/95;99;101;107;109;111;114;116

[58] Field of Search ..... 239/526; 222/153; 137/383, 384.2, 384.6, 384.8

[56] References Cited

U.S. PATENT DOCUMENTS

| | | | |
|---|---|---|---|
| 1,101,464 | 6/1914 | McDonald | 251/109 X |
| 2,690,321 | 9/1954 | Luna et al. | 251/116 |
| 3,633,828 | 1/1972 | Larson | 239/526 X |
| 4,018,292 | 4/1977 | Roll et al. | 251/109 X |

*Primary Examiner*—Andres Kashnikow

*Attorney, Agent, or Firm*—James V. Tura; Robert E. McDonald

[57] ABSTRACT

An automatic safety mechanism for airless spray equipment such as airless spray guns of the type having a trigger mechanism for actuating a gun spraying mechanism is provided. The safety mechanism comprises a lock mechanism for automatically locking the trigger mechanism in an "off" or non-spraying position upon full release thereof, including a locking member spring biased and disposed so that upon full release of the trigger mechanism the locking member is automatically operatively interposed between the trigger mechanism and hand-grip element of the spray gun to obstruct actuating movement of the trigger mechanism. The locking member is adapted for simple manipulation by the spray gun operator to disengage the lock mechanism and permit actuating movement of the trigger mechanism. The spray gun operator is thus enabled to fully operate the spraying mechanism with one hand and shut off the flow of paint without engagement of the lock mechanism; at the same time the operator is protected from inadvertent actuation of the spraying mechanism, since after the trigger mechanism has been fully released, the lock mechanism must be intentionally disengaged to permit actuating movement of the trigger.

3 Claims, 8 Drawing Figures

FIG. 5
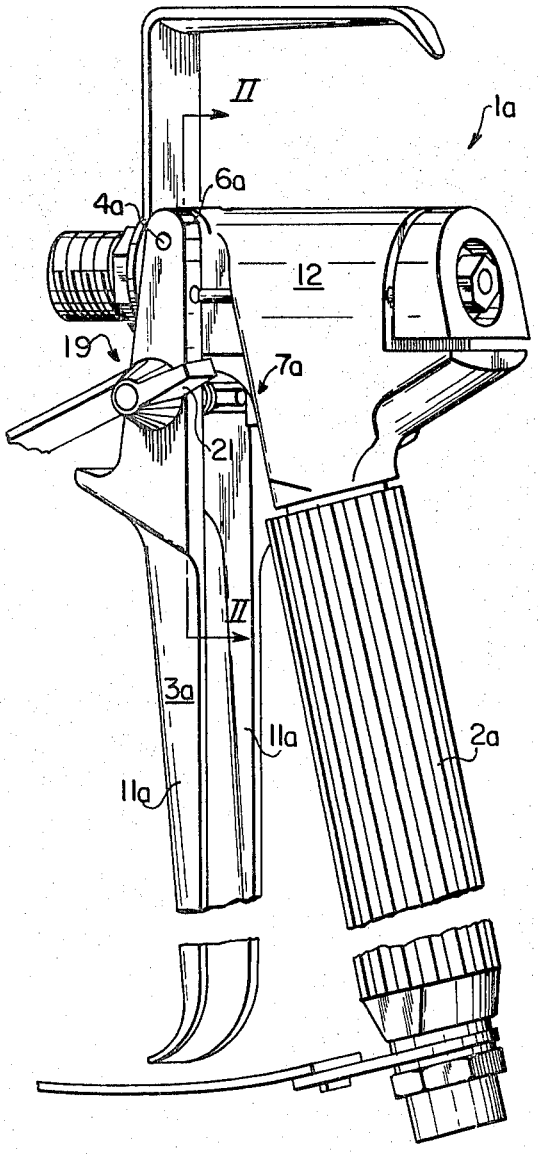
FIG. 6
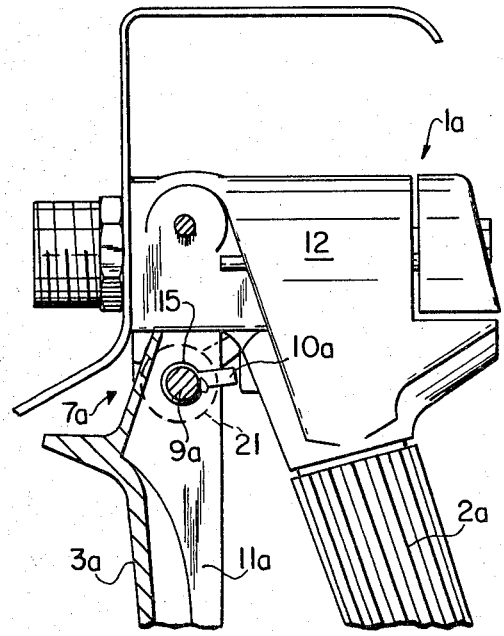
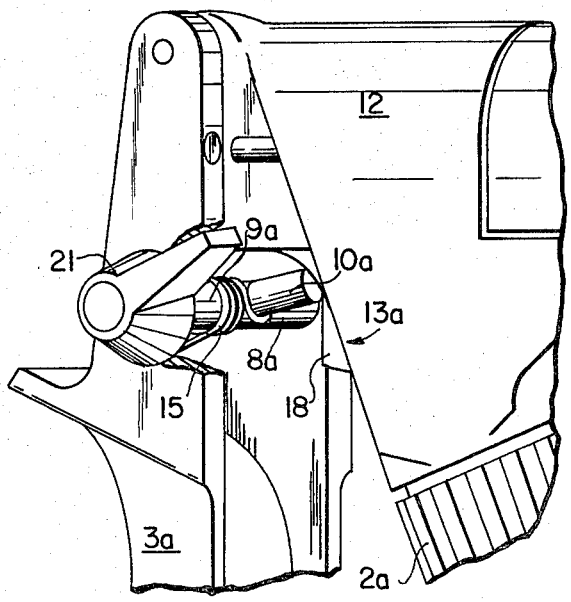
FIG. 7
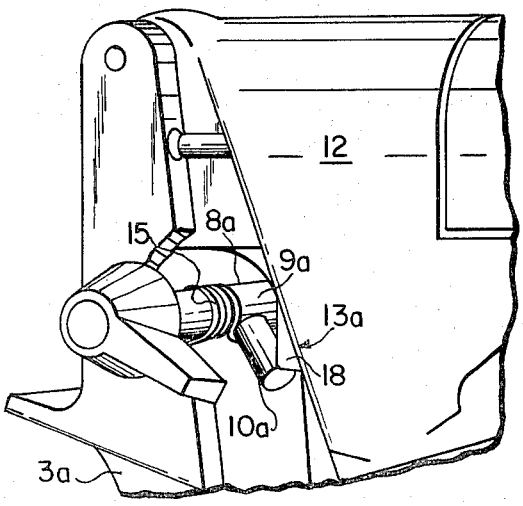
FIG. 8

LOCK-OFF MEANS FOR AIRLESS SPRAYER

This invention relates to airless spray equipment. In particular, the invention relates to safety mechanisms for such airless spray equipment.

BACKGROUND OF THE INVENTION

Airless spray equipment such as airless paint sprayers is customarily employed in many painting applications. According to conventional airless spraying techniques, the paint or other fluid is maintained in the airless spray equipment under very high hydraulic pressure; this equipment on actuation typically produces spray at from about one to four thousand psi. Airless spray equipment, particularly the manually operated equipment such as airless spray guns, is thus inherently hazardous, as the paint spray in close proximity to the skin of the operator may cause injury to the skin, and further, the highly pressurized spray is capable of penetrating exposed portions of the body, thereby injecting paint into the body.

In order to minimize these hazards, numerous safety mechanisms for use in conjunction with such equipment have been proposed. Typically, these safety mechanisms have the disadvantage of requiring manual operation to inactivate the spray equipment, and the efficacy of such safety mechanisms is therefore determined by the conscientiousness of the equipment operator and limited to non-emergency situations. While automatic safety mechanisms, such as that described in U.S. Pat. No. 3,913,844 to Petrovic, are also known in the prior art, mechanisms such as those described by Petrovic are limited in their application to specific circumstances, for example, automatic disablement of the spray equipment when the equipment is dismantled for cleaning.

Accordingly, it is an object of the present invention to provide an automatic safety mechanism for airless spray equipment which substantially minimizes the hazards associated with the use of such equipment.

It is another object of this invention to provide a safety mechanism for manually-operated airless spray equipment such as airless spray guns which is automatically activated on full release of the spray equipment actuating mechanism.

It is an additional object of this invention to provide a safety mechanism for airless spray equipment such as airless spray guns which automatically functions to prevent accidental operation of the spray equipment actuating mechanism, but which can be readily counteracted by the equipment operator.

SUMMARY OF THE INVENTION

The invention comprises an automatic safety mechanism for airless spray equipment such as airless spray guns of the type having trigger means for actuating the gun spraying mechanism, comprising lock means for automatically locking the trigger means of the spray gun in an "off" or non-spraying position upon full release thereof by the operator. The lock means is adapted for manipulation by the spray gun operator to prevent the automatic locking of the trigger in the "off" position or to disengage the lock means to permit operation of the trigger.

The lock means of the invention includes a locking member spring-biased for operative interposition between the trigger and the hand-grip elements of the spray gun to thereby obstruct operation of the trigger into an "on" or spraying position. The locking member is spring-biased and disposed so that upon full release of the trigger, the locking member is automatically interposed between the trigger and hand-grip elements to prevent actuating movement of the trigger, unless the action of the spring is offset by the operator.

The lock means is manually disengageable by manual retraction of the locking member from its operative position interposed between the hand-grip and trigger elements of the gun; preferably, the lock means further includes retraction means such as a lever for facilitating manual retraction of the locking member to an inoperative position. In the preferred embodiment of the invention the lock means further includes stop means for positively engaging the locking member in its operative position and for resisting premature inadvertent engagement of the locking member in the operative position during manipulation of the trigger by the operator.

BRIEF DESCRIPTION OF THE DRAWING

FIG. 5 is a perspective elevation of the spray nozzle head of an airless spray gun incorporating an alternate embodiment of the safety mechanism of this invention;

FIG. 6 is a partial sectional view along the lines II—II of FIG. 5;

FIG. 7 is an enlarged perspective elevation of the safety mechanism of FIG. 5 in detail, showing the safety mechanism operating to lock the spray nozzle trigger in "off" position; and FIG. 8 is an enlarged perspective elevation of the safety mechanism of FIG. 5 in detail, showing the safety mechanism operating to permit actuation of the spray nozzle trigger.

DETAILED DESCRIPTION OF THE DRAWINGS

Figure 1:
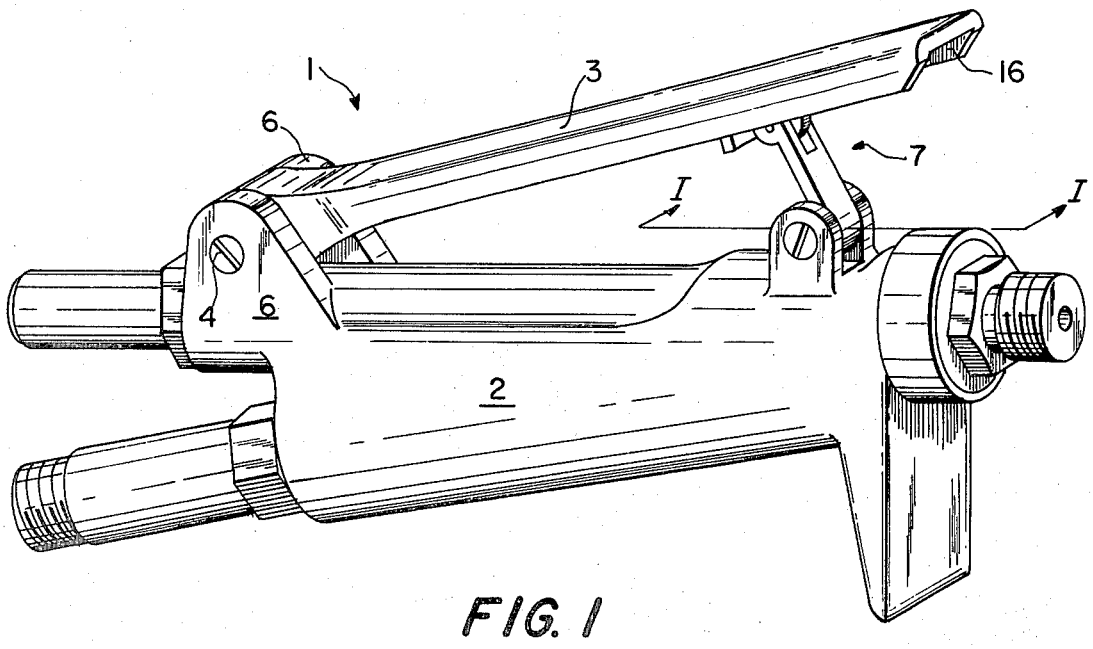
FIG. 1 is a perspective elevation of the spray nozzle head of an airless spray gun incorporating one embodiment of the safety mechanism of this invention.
Figure 2:
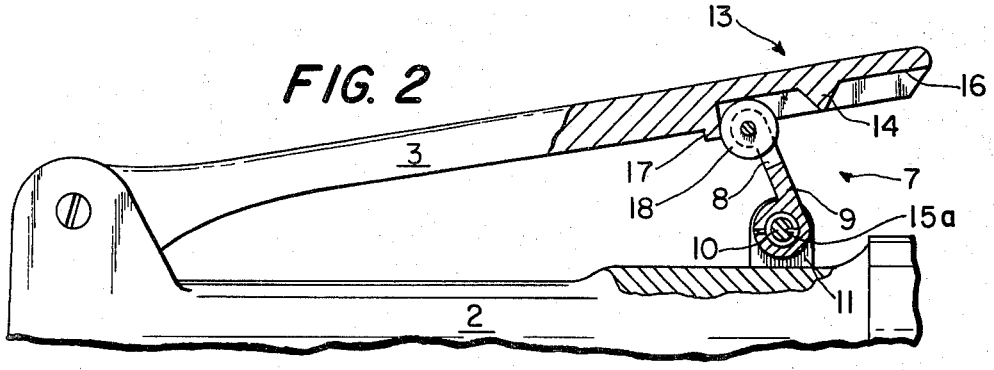
FIG. 2 is a partial sectional view along the lines I—I of FIG. 1.
Figure 3:
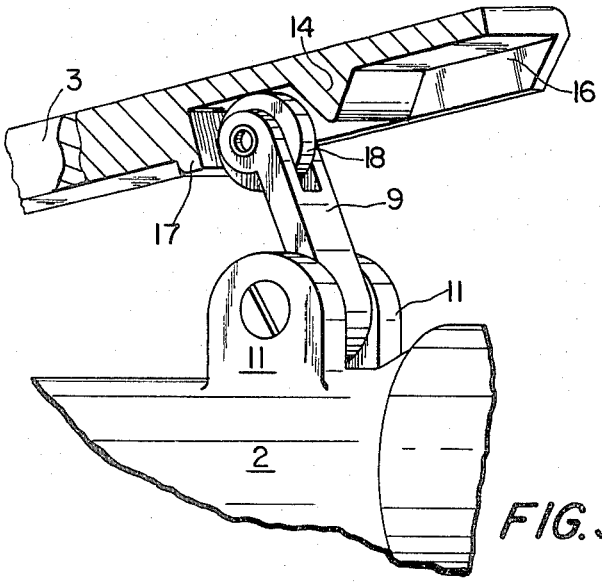
FIG. 3 is an enlarged perspective elevation of the safety mechanism of FIG. 1, in detail, showing the safety mechanism operating to lock the spray nozzle trigger in "off" position.
Figure 4:
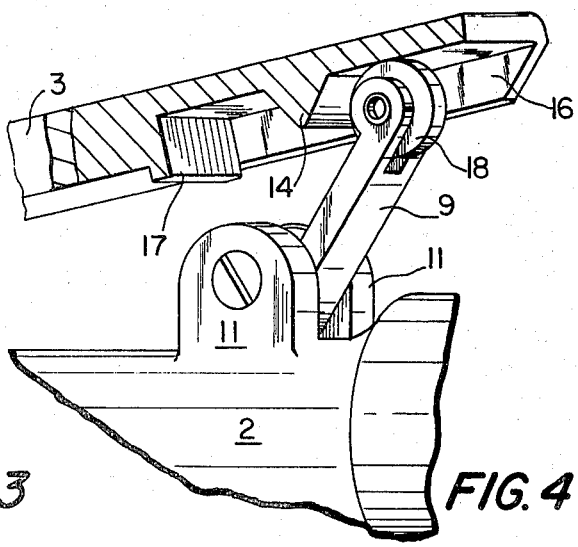
FIG. 4 is an enlarged perspective elevation of the safety mechanism of FIG. 1 in detail, showing the safety mechanism operating to permit actuation of the spray nozzle trigger.

With particular reference to FIGS. 1–4, an airless spray gun nozzle head is generally shown at 1, with associated hand-grip element 2 and a trigger element 3 which pivots about a trigger pivot pin 4 disposed between projections 6 on the rear portion of hand-grip element 2. The nozzle head 1 further includes the safety mechanism of this invention, comprising lock means generally indicated at 7. As best seen in FIGS. 2–4, the lock means 7 includes a locking member 8 comprising a rigid arm locking member 9 pivotally engaged with a lock pivot pin 10 disposed between projecting ears 11 on the inner surface of hand-grip element 2. The locking member 8 is spring-biased as by tension spring 15*a* towards the rear portion of the nozzle 1 so that the arm member 9 is urged toward the position shown in FIG. 2, where it is interposed between trigger 3 and hand-grip 2 and acts to obstruct pivotal movement of the trigger 3 toward the hand-grip element 2.

The lock means 7 further includes stop means, generally indicated at 13, for positively engaging the locking member 8 and for resisting premature inadvertent engagement of the locking member 8 in the operative position shown in FIG. 2, comprising a first cross-bar member 14 transversely disposed in track means for receiving and guiding the distal end of arm locking member 9 such as a longitudinal slot 16 in the distal portion of trigger element 3. As best seen in FIGS. 3 and 4, the first cross-bar member 14 is disposed forwardly of a second cross-bar member 17 at the proximal end of slot 16 to intersect the path of the arm locking member 9 within the slot 16; the first cross-bar member 14 projects sufficiently to obstruct the travel of the arm locking member 9 within the slot 16 when the trigger element 3 is depressed in an "on" or spraying position, as shown in FIG. 4, but also permits the arm locking member 9 to clear the first cross-bar member 14 and travel to the end of the slot 16 to abut the second cross-bar member 17 upon full release of the trigger element 3 to the "off" or non-spraying position, as shown in FIG. 3. Preferably, the first cross-bar member 14 is tapered as shown, and the arm locking member 9 includes bearing means such as wheel 18 on the distal end thereof for facilitating travel of the arm locking member 9 within the slot 16. The second cross-bar member 17 projects sufficiently to prevent disengagement of the wheel 18 with the slot 16 when the trigger element 3 is fully released.

With particular reference to FIGS. 5–8, spray gun nozzle head 1*a* is shown with associated hand-grip element 2*a* and trigger element 3*a* which pivots about trigger pivot pin 4*a* disposed between projections 6*a* on the trigger element 3*a* of nozzle head 1*a*. The nozzle head 1*a* further includes an alternate embodiment of the safety mechanism of this invention, comprising lock means generally indicated at 7*a*. As best seen in FIGS. 6–8, the lock means 7*a* includes a rigid T-shaped locking member 8*a* comprising horizontal element 9*a* and vertical element 10*a*; horizontal element 9*a* is disposed between side portions 11*a* on trigger 3*a* for pivotal engagement therewith. Locking member 8*a* is spring-biased by a spring 15 toward the barrel portion 12 of spray gun nozzle head 1*a* so that vertical element 10*a* is urged toward the position shown in FIG. 6, where it is interposed between trigger 3*a* and hand-grip 2*a* and acts to obstruct pivotal movement of trigger 3*a* toward hand-grip 2*a*.

Lock means 7*a* further includes stop means 13*a*, which functions as previously described. Stop means 13*a* in this embodiment comprises a projecting wedge 18 vertically disposed on hand-grip 2*a* in the path of vertical element 10*a* of locking member 8*a*. As best seen in FIGS. 7 and 8, the wedge 18 projects sufficiently to obstruct the travel of the vertical element 10*a* along hand-grip 2*a* when the trigger 3*a* is depressed in an "on" or spraying position, as shown in FIG. 8, but also permits the vertical member 10*a* to clear the head portion of the wedge 18 when the trigger 3*a* is fully released for operative positive engagement of the vertical member 10*a* between the head of wedge 18 and the underside of the barrel 12, as shown in FIG. 7.

The lock means 7*a* also includes retraction means generally indicated at 19 comprising a lever 21 affixed to horizontal element 9*a* of locking member 10*a* for facilitating retraction of the vertical element 10*a* of locking member 8*a* from the operative position illustrated in FIG. 7 to the inoperative position illustrated in FIG. 8, thereby disengaging lock means 7*a*. The lever 21 is preferably disposed for convenient manipulation by the thumb of the operator.

The safety mechanism of the invention operates as follows:

With particular reference to the embodiment of the invention, of FIGS. 1–4, trigger 3 of nozzle 1 is operated by the operator by pivotal movement of the trigger 3 about trigger pin 4 toward hand-grip 2 to actuate the spraying mechanism and place the trigger in an "on" or spraying position. Simultaneously with the reciprocal movement of trigger 3 to various "on" positions, wheel 18 of locking member 8 travels reciprocally within slot 16 between first cross-bar member 14 and the distal end of slot 16. As the trigger 3 is fully released, the action of the spring biasing arm locking member 9 forces the wheel 18 over the first cross-bar member 14 and up against the second cross-bar member 17, as shown in FIG. 2. In this position, lock means 7 is positively engaged, and further operation of the trigger 3 is prevented by arm locking member 9, now rigidly interposed between trigger 3 and hand-grip 2. To continue spraying the operator disengages lock means 7 by manually retracting arm locking member 9 from the position shown in FIG. 2, and operating of the trigger 3; after slight operation of the trigger 3, the arm locking member 9 may be released by the operator as it will then be automatically retained in the inoperative position shown in FIG. 4 until the trigger 3 is again fully released. The engagement of lock means 7 upon full release of the trigger 3 may be prevented by manual restraint of the arm locking member 9 against the force of the biasing spring (not shown).

The embodiment of the invention illustrated in FIGS. 5–8 operates in a similar fashion. As the trigger 3*a* is fully released, the action of the spring 15 urges vertical element 10*a* towards the barrel portion 12 of nozzle 1*a*, forcing the distal end of the vertical element 10*a* over projecting wedge 18 and up against the underside of the barrel 12, as shown in FIG. 7. In this position, lock means 7*a* is positively engaged, and further operation of the trigger 3*a* is prevented by vertical element 10*a*, now rigidly interposed between hand-grip 2*a* and trigger 3*a*. To continue spraying, the operator disengages lock means 7*a* by thumbing the lever 21 to retract the vertical element 10*a* from the position shown in FIG. 6, and operates the trigger 3; after slight operation of the trigger 3, the lever 21 may be released by the operator as the vertical element 10*a* will then be automatically retained in the inoperative position shown in FIG. 8 until the trigger 3 is again fully released. The engagement of lock means 7*a* upon full release of the trigger 3 may be prevented by holding lever 21 to restrain the action of vertical element 10*a* against the force of spring 15.

I claim:

1. In an airless spray gun of the type having a nozzle including hand-grip means for manually grasping the nozzle and associated trigger means for actuating a gun spraying mecahnism by pivotal movement of the trigger means toward the hand-grip means, the improvement comprising manually disengageable lock means for automatically preventing actuating movement of said trigger means including a rigid locking member spring-biased and disposed for automatic operative interposition between said hand-grip and trigger means upon full release of said trigger means, said rigid locking member comprising a rigid arm locking member pivotally engaged at one end thereof with said hand-grip means so that the distal end thereof bears against said trigger means and spring-biased so that said rigid arm locking member is urged toward an operative position obstructing actuating movement of said trigger means as said trigger means moves away from said hand-grip means, said lock means further including track means disposed on said trigger means for receiving and guiding the distal end of said rigid arm locking member, and said rigid arm locking member including bearing means on the distal end thereof for facilitating travel of the rigid arm locking member within said track means.

2. The invention of claim 1 wherein said track means comprises a slot longitudinally disposed in said trigger means, and said lock means further includes stop means for positively engaging said rigid arm locking member in said operative position and for resisting inadvertent premature positive engagement of said arm locking member, said stop means comprising a cross-bar member transversely disposed within said slot.

3. The invention of claim 2, wherein said cross-bar member is tapered.

* * * * *